US006767271B2

(12) United States Patent
Tsui

(10) Patent No.: US 6,767,271 B2
(45) Date of Patent: Jul. 27, 2004

(54) SENSOR SWITCH ASSEMBLY

(75) Inventor: Sam Tsui, Hong Kong (HK)

(73) Assignee: Mattel, Inc., El Segundo, CA (US)

( * ) Notice: Subject to any disclaimer, the term of this patent is extended or adjusted under 35 U.S.C. 154(b) by 0 days.

(21) Appl. No.: 10/251,314

(22) Filed: Sep. 20, 2002

(65) Prior Publication Data

US 2003/0153241 A1 Aug. 14, 2003

Related U.S. Application Data

(60) Provisional application No. 60/324,080, filed on Sep. 21, 2001.

(51) Int. Cl.[7] ..... A63H 3/28

(52) U.S. Cl. ..... 446/304; 446/395

(58) Field of Search ..... 446/295, 296, 446/297, 298, 299, 300, 301, 304, 397, 97, 395

(56) References Cited

U.S. PATENT DOCUMENTS

| | | | | |
|---|---|---|---|---|
| 3,846,934 A | * | 11/1974 | Thorn et al. | 446/191 |
| 4,224,759 A | | 9/1980 | Saint-Pierre et al. | |
| 4,231,184 A | | 11/1980 | Corris et al. | |
| 4,276,714 A | | 7/1981 | Albert et al. | |
| 4,582,499 A | | 4/1986 | Saigo et al. | |
| 4,595,379 A | * | 6/1986 | Rasmussen et al. | 446/341 |
| 5,125,865 A | | 6/1992 | Orenstein et al. | |
| 5,190,492 A | | 3/1993 | Berenguer | |
| 5,290,198 A | | 3/1994 | Nakayama | |
| 5,713,778 A | * | 2/1998 | Radosevich et al. | 446/304 |
| 5,853,315 A | | 12/1998 | Satoh | |
| 5,975,979 A | | 11/1999 | Ferri Llorens | |
| 6,071,169 A | * | 6/2000 | Cook | 446/300 |
| 6,135,845 A | | 10/2000 | Klimpert et al. | |
| 6,471,565 B2 | * | 10/2002 | Simeray | 446/298 |

FOREIGN PATENT DOCUMENTS

| | | |
|---|---|---|
| DE | 27 03 240 | 9/1977 |
| DE | 2847-629 | 11/1979 |
| EP | 0 529 171 A1 | 3/1993 |

* cited by examiner

*Primary Examiner*—Jacob K. Ackun
(74) *Attorney, Agent, or Firm*—Kolisch Hartwell, P.C.

(57) ABSTRACT

A sensor switch assembly intended for use inside a simulated mouth of a doll. The assembly include a fixed structure having a guide channel and a micro-switch attached near the guide channel, a movable structure having a floating pivot that may pivot within and slide along the guide channel so that the micro-switch may be triggered by any combination of sliding or pivoting of the movable structure.

34 Claims, 2 Drawing Sheets

SENSOR SWITCH ASSEMBLY

CROSS-REFERENCE TO RELATED APPLICATIONS

This application is based upon and claims priority under 35 U.S.C. §119(e) to the following U.S. provisional patent application, which is incorporated herein by reference in its entirety for all purposes: Ser. No. 60/324,080, entitled "Sensor Switch Mechanism," filed Sep. 21, 2001.

FIELD OF THE INVENTION

The present invention generally relates to a sensor switch assembly for animated interactive toys, and more particularly to a sensor switch assembly for determining the presence of an object, such as a thumb or bottle, in the mouth of an animated toy doll.

BACKGROUND OF THE INVENTION

Interactive toys are popular for children. Interactive toys often include various sensors for providing the toy with information about the toy's environment, or about actions being taken by a child playing with the toy. Examples of such toys are found in U.S. Pat. Nos. 3,767,901, 3,912,694, 4,825,136, 4,840,602, 4,900,289, 5,141,464, 5,158,492, 5,191,615, 5,281,143, 5,413,516, 5,636,994, 5,820,441, 6,048,209, and 6,149,490, and in WO0035548, WO0044461, and WO0149383, the disclosures all of which are incorporated herein by reference.

The operation of one prior art solution for a sensor switch assembly is shown in FIGS. 2–5. The prior art switch assembly has a plate mounted to a body of the assembly about a fixed pivot pin, and a micro-switch that is triggered by pivoting of the plate about the pin. FIG. 2 shows a head of a toy with a bottle poised for insertion into a mouth of the toy. FIG. 3 shows the configuration of the prior art sensor switch assembly without a bottle or other object inserted into the mouth of the toy.

As shown in FIG. 3, the plate is approximately horizontal extending along the roof of the toy's mouth. The micro-switch is not activated when the mouth is empty because it is being held in the un-activated positioned by a generally vertical arm connected to the plate. The micro-switch also may not be activated when a nipple of a bottle or other item is inserted into the mouth in a horizontal position, as shown in dashed lines, because no pivoting force is exerted on the plate. This may lead to frustration on the part of a child playing with the prior art toy, because the toy will fail to respond as might otherwise be expected by the child.

FIG. 4 shows a bottle inserted into the mouth of the prior art toy, with an upward tilt. This position of the bottle is what is often necessary to activate the prior art sensor switch assembly, because of the limitations of this assembly. As shown in FIG. 5, the plate that was approximately horizontal is now inclined with the rear portion higher than the front portion. Upward movement of the rear portion of the plate causes the vertical arm to move forward away from the micro-switch allowing it to move to the actuated position.

SUMMARY OF THE INVENTION

The disclosed sensor switch assembly is intended for use inside a simulated mouth of a doll. The assembly includes a fixed structure having a guide channel, a micro-switch attached near the guide channel, and a movable structure having a floating pivot that may slide along the guide channel so that the micro-switch may be triggered by any combination of sliding or pivoting of the movable structure.

The advantages of the present invention will be understood more readily after a consideration of the drawings and the Detailed Description.

DETAILED DESCRIPTION AND BEST MODE OF THE INVENTION

Figure 1:
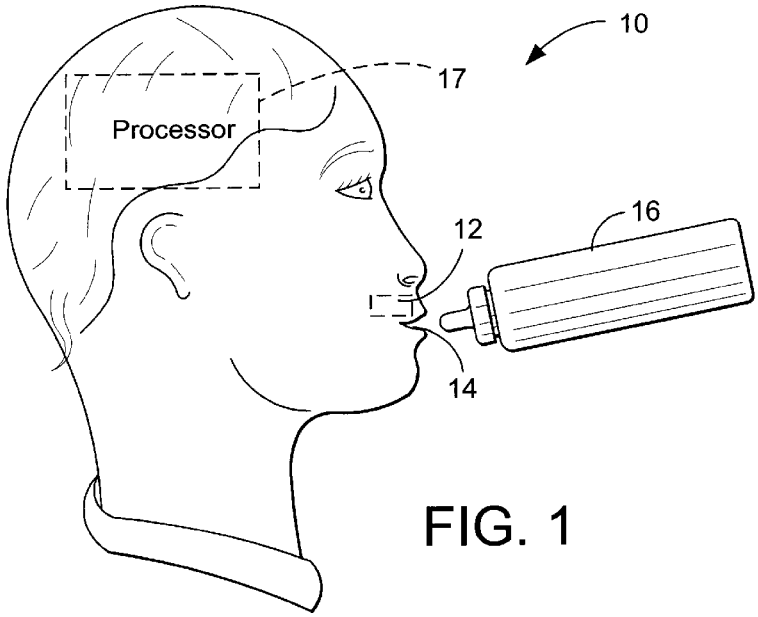
FIG. 1 is a side view of a head of a toy according to one embodiment of the present invention, showing the location of a sensor switch assembly in a mouth of the toy.
Figure 2:
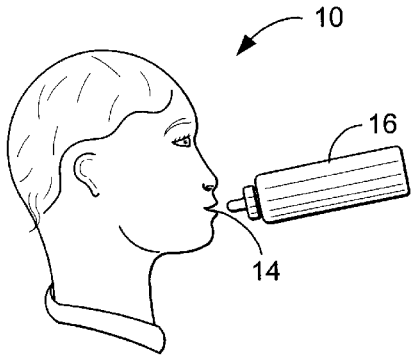
FIG. 2 includes a side view of a head of a toy with a bottle poised for insertion in a mouth of the toy.
Figure 3:
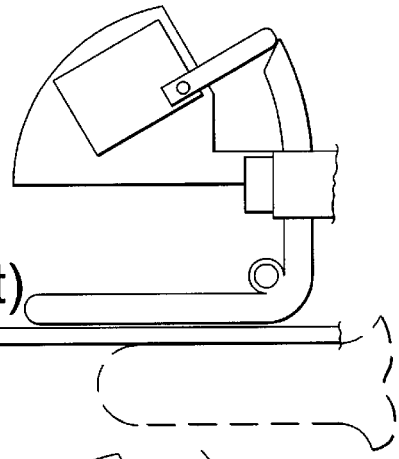
FIG. 3 (Prior Art)
FIG. 3 includes an enlarged cut-away side view of a prior art embodiment for a sensor switch assembly.
Figure 4:
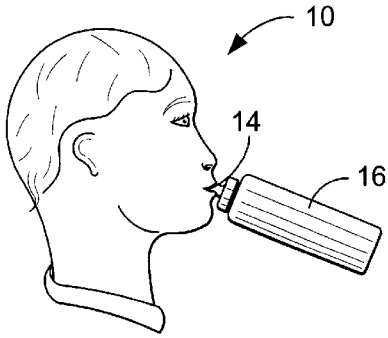
FIG. 4 includes a side view of a head of a toy with a bottle inserted into the mouth of the toy.
Figure 5:
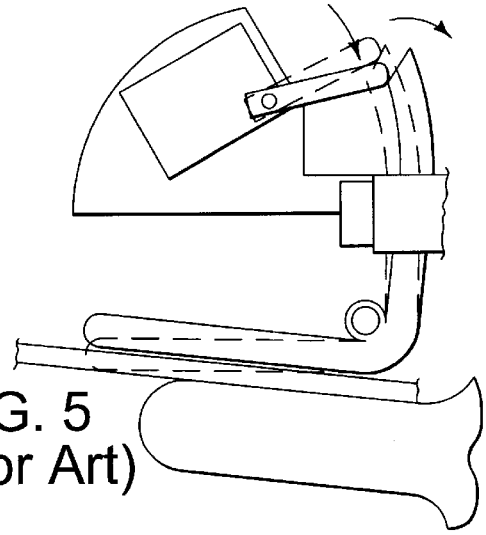
FIG. 5 (Prior Art)
FIG. 5 includes an enlarged cut-away side view of the prior art switch assembly of FIG. 3, with the bottle inserted into the mouth of the toy as shown in FIG. 4.

Turning initially to FIG. 1, a head of a toy according to one embodiment of the present invention is indicated generally at 10. Head 10 includes a switch assembly 12 for sensing the presence of a foreign object in an opening, or mouth 14, of head 10. The foreign object may be a bottle 16, as shown in FIG. 1, or may be a thumb, pacifier, or any other object sized to fit in mouth 14. Inserting bottle 16 into mouth 14 triggers switch assembly 12 to signal a processor 17, or other electrical device, that a foreign object is located in mouth 14 of head 10.

As explained above, FIGS. 2–5 illustrate the operation of a prior art sensor switch assembly. One disadvantage of the prior art sensor switch assembly is that an object may be inserted into the mouth of the toy in certain orientations that may not cause rotation of the triggering plate as is required to activate the micro-switch. The present invention solves this problem of the prior art sensor switch assembly.

As shown in FIGS. 1, and 6–11, sensor switch assembly 12 may be positioned above mouth 14. Sensor switch assembly 12 includes a fixed structure or member 18 mounted to the interior of head 10 and a movable structure or plate 20 configured to move relative to fixed structure 18 in response to the insertion of a foreign object in mouth 14. Movement of movable structure 20 relative to fixed structure 18 causes switch 12 to signal the presence of a foreign object to processor 17. Processor 17 may be any suitable processor capable of executing a set of instructions and performing calculation; for example, processor 17 may be a microprocessor, programmable logic circuit, or similar device for performing computational tasks related to the operation of the toy, or it may be a simple electrical devise such as a motor or light.

Movable structure 20 may be coupled to fixed structure 18 by a floating pivot 22. Fixed structure 18 may include a guide channel 24 configured to permit floating pivot 22 to slide relative to fixed structure 18. Guide channel 24 confines the linear movement of floating pivot 22 to a defined path, while allowing movable structure 20 to rotate. Typically, guide channel 24 may have a c-shaped structure.

Switch assembly 12 further includes a micro-switch 28 mounted on, or attached to, fixed structure 18. Micro-switch 28 may be connected to processor 17 by a wiring harness or similar suitable electrical connection.

Sensor switch assembly 12 may include a biasing member 26 urging movable structure 20 downwardly away from fixed structure 18. Biasing member 26 may be a coil spring, a leaf spring, a cantilevered spring, an elastomeric material, or similar biasing structure. Biasing member 26 may be configured to maintain movable structure 20 in an open or unactuated position.

Movable structure 20 includes a contact arm 30 extending generally parallel to the roof of mouth 14, and an actuator arm 32 extending at an angle upwardly from contact arm 30. It will be understood that contact arm 30 may also be referred to as a lower arm and that actuator arm 32 may also be referred to as an upper arm. Contact arm 30 includes a first end or portion spaced away from floating pivot 22 and a second end or portion proximate to floating pivot 22.

Figure 7:
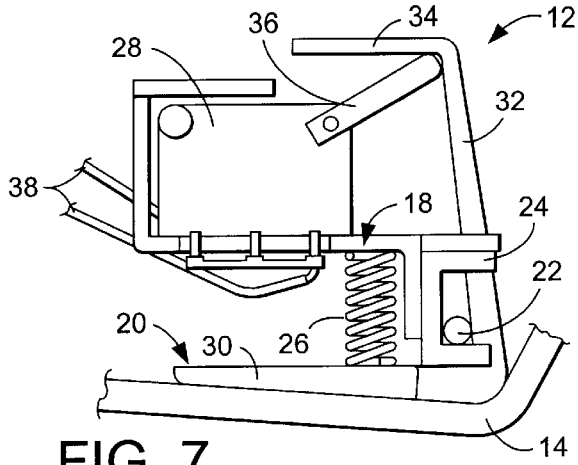
FIG. 7 includes an enlarged cut-away view of a sensor switch assembly according to the present invention showing a configuration of the sensor switch assembly when no object is inserted in the mouth of the toy.

Movable structure 20 is coupled with fixed structure 18 by floating pivot 22 and biasing member 26, as noted above. Biasing member 26 may bias movable structure 20 into a normal position, where floating pivot 22 is positioned within guide channel 24 at an end point, or boundary thereof. In the normal position, micro-switch 28 is in an unactuated configuration. Biasing member 26 couples to fixed structure 18 and contact arm 30, such that it biases contact arm 30 toward a down position, as shown in FIG. 7. Actuator arm 32 may be rigidly coupled with contact arm 30, such that a bias downward against contact arm 30 causes a corresponding bias rearward in actuator arm 32. Actuator arm 32 may be positioned at an angle relative to contact arm 30.

Actuator arm 32 includes a cam structure 34 positioned on or about an end of the actuator arm 32 spaced away from floating pivot 22. Cam structure 34 is configured to engage a lever 36 positioned on micro-switch 28.

Micro-switch 28 may be mounted to fixed structure 18 above biasing member 24. Micro-switch 28 may be electrically connected to processor 17 by electrical leads 38. As noted above, micro-switch 28 includes a micro-switch actuator lever 36. Lever 36 may have an internal bias toward an actuated position.

Cam 34 of actuator arm 32 may be configured to hold lever 36 in the unactuated position as a result of the bias induced in movable structure 20 by biasing member 26. In this configuration cam 34 causes lever 36 to move in response to forces applied to contact arm 30.

Figure 6:
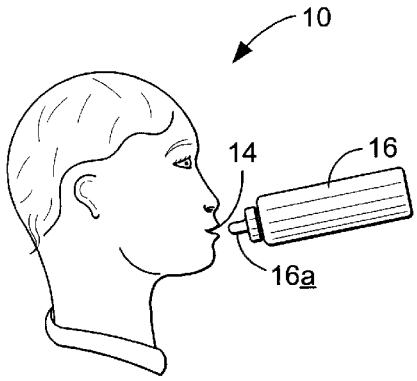
FIG. 6 includes a side view of a head of the toy of FIG. 1, with a bottle poised for insertion into the mouth of the toy.

FIG. 6 shows toy 10 without an object inserted into mouth 14. FIG. 7 illustrates the configuration of sensor switch assembly 12 when, as in FIG. 6, no object is inserted into mouth 14. Without an object inserted into mouth 14, switch 12 is in an unactuated position.

Figure 8:
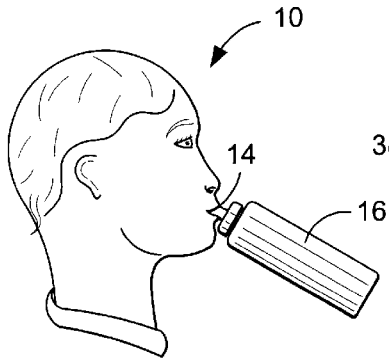
FIG. 8 includes a side view of a head of the toy of FIG. 1, showing a bottle inserted into the mouth of the toy.
Figure 9:
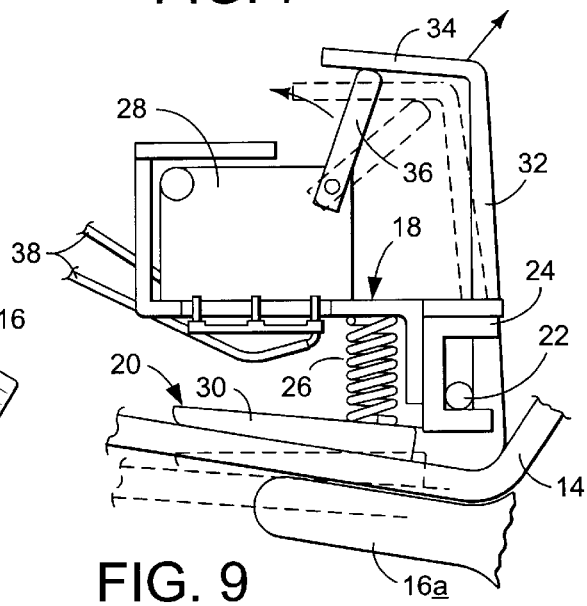
FIG. 9 shows the sensor switch assembly configuration for the sensor switch assembly of FIG. 7, corresponding to the bottle inserted into the mouth of the toy, as shown in FIG. 8.

FIGS. 8 and 9 show a nipple 16*a* of bottle 16 inserted into mouth 14 to press upwardly on the distal end of contact arm 30. This causes movable structure 20 to rotate about floating pivot 22, which in turn moves cam 34 away from lever 36. Applying an upward force on contact arm 30 causes cam 34 to disengage lever 36, permitting lever 36 to move to an actuated position and cause the micro-switch to signal processor 17 that an object has been inserted into mouth 14.

Figure 10:
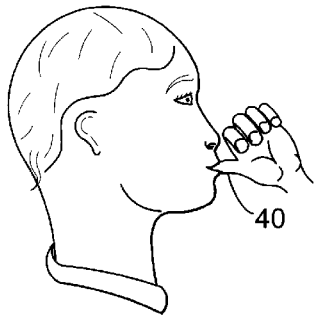
FIG. 10 includes a side view of a head of the toy of FIG. 1, with a thumb inserted into the mouth of the toy.
Figure 11:
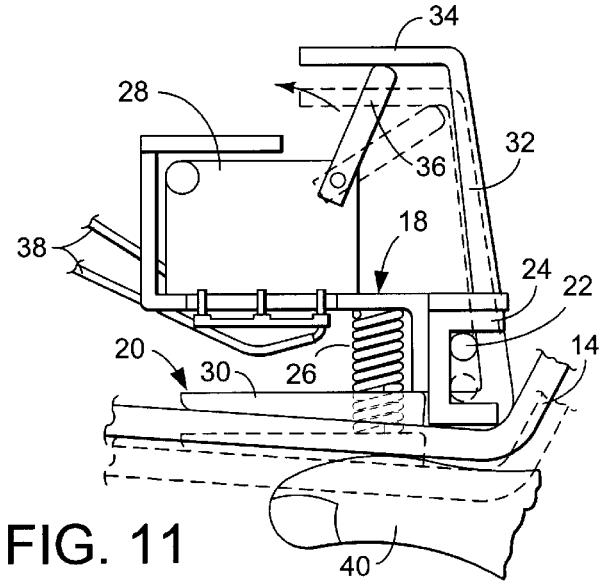
FIG. 11 shows the sensor switch assembly configuration for the sensor switch assembly of FIGS. 7 and 9, corresponding to the thumb inserted into the mouth of the toy, as shown in FIG. 10

Another example is shown in FIGS. 10 and 11, in which a thumb 40 is inserted in mouth 14. Thumb 40 applies upward pressure on contact arm 30 directly below floating pivot 22. Moveable structure 20 responds to this upward pressure on contact arm 30 by translating or moving linearly upward. Floating pivot 22 moves upward toward the top of guide channel 24 of fixed structure 18. This upward movement of moveable structure 20 causes cam 34 of actuator arm 32 to disengage lever 36, thereby enabling the internal bias of micro-switch 28 to move lever 36 to the actuated position.

Objects inserted into mouth 14 that apply an upward force along any portion of contact arm 30 may cause cam 34 to disengage lever 36, thereby causing micro-switch 28 to change to the actuated position and signal the processor that an object has been detected in mouth 14 of toy 10. Floating pivot 22 is configured to engage and travel along guide channel 24 enabling movable structure 20 to pivot and translate relative to fixed structure 18. This design enables actuator arm 32 to actuate micro-switch 28 when an object contacts anywhere along the length of contact arm 30.

As demonstrated by the above description of FIGS. 6–11, sensor switch assembly 12 of the present invention senses a greater variety of foreign objects inserted into mouth 14 than did the prior art switch assembly of FIGS. 2–5. In particular, switch assembly 12 permits shorter objects that apply pressure closer to the front of mouth 14 to actuate micro-switch 28. At the same time, switch assembly 12 permits thinner objects that apply pressure closer to the back of mouth 14 to actuate micro-switch 28.

It is believed that the disclosure set forth above encompasses multiple distinct inventions with independent utility. While each of these inventions has been disclosed in its preferred form, the specific embodiments thereof as disclosed and illustrated herein are not to be considered in a limiting sense as numerous variations are possible. The subject matter of the inventions includes all novel and non-obvious combinations and subcombinations of the various elements, features, functions and/or properties disclosed herein. Similarly, where the claims recite "a" or "a first" element or the equivalent thereof, such claims should be understood to include incorporation of one or more such elements, neither requiring nor excluding two or more such elements.

It is believed that the following claims particularly point out certain combinations and subcombinations that are directed to one of the disclosed inventions and are novel and non-obvious. Inventions embodied in other combinations and subcombinations of features, functions, elements and/or properties may be claimed through amendment of the present claims or presentation of new claims in this or a related application. Such amended or new claims, whether they are directed to a different invention or directed to the same invention, whether different, broader, narrower or equal in scope to the original claims, are also regarded as included within the subject matter of the inventions of the present disclosure.

I claim:

1. A doll having a mouth sensor switch mechanism comprising:

a doll body;

a doll head having a mouth;

a fixed structure mounted internal to the doll head near the mouth, configured to support a micro-switch, and including a guide channel;

a movable structure including a contact arm and an actuator arm, wherein the actuator arm is configured to actuate the micro-switch; and a floating pivot positioned on the movable structure and configured to pivot within and travel along the guide channel, enabling the actuator arm to actuate the micro-switch.

2. The doll of claim 1, wherein:

the contact arm includes a first portion and a second portion;

a force may be applied to the first portion of the contact arm to cause the movable structure to rotate relative to the fixed structure, actuating the micro-switch; and a force may be applied to the second portion to cause the movable structure to translate relative to the fixed structure, actuating the micro-switch.

3. The doll of claim 2, further comprising a biasing member configured to bias the movable structure into a position holding the micro-switch in an unactuated position.

4. The doll of claim 3, wherein the biasing member is a coil spring.

5. A sensor switch mechanism comprising:

a fixed structure including a support member and a guide channel;

a movable structure including an elongate contact arm configured to contact an object and an actuator arm configured to actuate a micro-switch held by the support member of the fixed structure; and a floating pivot positioned on the movable structure and configured to engage and travel along the guide channel, enabling the movable structure to pivot and translate relative to the fixed structure and enabling the actuator arm to actuate the micro-switch when an object contacts the contact arm.

6. The sensor switch mechanism of claim 5, wherein the guide channel is c-shaped.

7. The sensor switch mechanism of claim 5, wherein the elongate contact arm of the movable structure includes a first portion spaced away from the floating pivot and a second portion proximate to the floating pivot.

8. The sensor switch mechanism of claim 7, wherein the elongate arm is configured to cause the movable structure to pivot about the pivot when a force is applied to the first portion, thereby moving the actuator arm to actuate the micro-switch.

9. The sensor switch mechanism of claim 7, wherein the elongate lower arm is configured to cause the movable structure to translate linearly along the guide channel, thereby moving the upper arm to actuate the micro-switch.

10. The sensor switch mechanism of claim 5, wherein a biasing member movable structure relative to the fixed structure.

11. The sensor switch mechanism of claim 10, wherein the biasing member is a coil spring.

12. A sensor switch mechanism comprising:

a fixed structure including a support member configured to support a micro-switch and a guide channel;

a movable structure including a contact arm and an actuator arm, wherein the actuator arm is configured to actuate the micro-switch and the contact arm; and a floating pivot positioned on the movable structure configured to pivot within and travel along the guide channel, enabling the actuator arm to actuate the micro-switch.

13. The sensor switch mechanism of claims 12, wherein:

the contact arm includes a first portion spaced away from the floating pivot, and a second portion proximate the floating pivot;

applying a force to the first portion of the contact arm causes the movable structure to rotate, actuating the micro-switch; and applying a force to the second portion causes the movable structure to translate linearly, actuating the micro-switch.

14. The sensor switch mechanism of claim 13, further comprising a biasing member configured to bias the movable structure into a position holding the micro-switch in an unactuated position.

15. The sensor switch mechanism of claim 14, wherein the biasing member is a coil spring.

16. A toy configured to sense the presence of an object comprising:

a toy body;

an object-receiving opening;

a fixed structure mounted internal to the toy near the object-receiving opening, configured to support a micro-switch, and including a guide channel;

a movable structure including a contact arm and an actuator arm, wherein the actuator arm is configured to actuate the micro-switch; and a floating pivot positioned on the movable structure configured to pivot within and travel along the guide channel enabling the actuator arm to actuate the micro-switch.

17. The toy of claim 16, wherein:

the contact arm includes a first portion and a second portion;

applying a force to the first portion of the contact arm spaced away from the floating pivot causes the movable structure to rotate, actuating the micro-switch; and applying a force to the second portion proximate the floating pivot causes the movable structure to translate linearly, actuating the micro-switch.

18. The toy of claim 17, further comprising a biasing member configured to bias the movable structure into a position holding the micro-switch in an unactuated position.

19. The toy of claim 18, wherein the biasing member is a coil spring.

20. A sensor switch mechanism comprising:

a fixed structure including a support member and a guide channel;

a floating pivot configured to engage and travel along the guide channel pivotally and translationally relative to the fixed structure; and a movable structure including an elongate contact arm configured to contact an object and an actuator arm configured to actuate a micro-switch held by the support member of the fixed structure, wherein the movable structure couples with the fixed structure through the floating pivot.

21. The sensor switch mechanism of claim 20, wherein the guide channel is c-shaped.

22. The sensor switch mechanism of claim 20, wherein the elongate contact arm of the movable structure includes a first portion spaced away from the floating pivot and a second portion proximate to the floating pivot.

23. The sensor switch mechanism of claim 22, wherein the elongate contact arm is configured to cause the movable structure to pivot about the floating pivot when a force is applied to the first portion, thereby moving the actuator arm to actuate the micro-switch.

24. The sensor switch mechanism of claim 22, wherein the elongate lower arm is configured to cause the movable structure to translate linearly along the guide channel when a force is applied to the second portion, thereby moving the upper arm to actuate the micro-switch.

25. The sensor switch mechanism of claim 20, wherein a biasing member biases the movable structure relative to the fixed structure.

26. The sensor switch mechanism of claim 25, wherein the biasing member is a coil spring.

27. A doll having a mouth sensor switch assembly located in a head of the doll comprising:

a fixed structure mounted internal to the doll head near the mouth configured to support a micro-switch and including a guide channel;

a floating pivot configured to pivot within and travel along the guide channel; and a movable structure including a contact arm and an actuator arm, wherein:

the actuator arm is configured to actuate the micro-switch; and the movable structure couples with the fixed structure through the floating pivot.

28. The doll of claim 27, wherein:

the contact arm includes a first portion and a second portion;

applying a force to the first portion of the contact arm spaced away from the floating pivot point causes the movable structure to rotate, actuating the micro-switch; and applying a force to the second portion proximate the floating pivot causes the movable structure to translate linearly, actuating the micro-switch.

29. The doll of claim 28, further comprising a biasing member configured to bias the movable structure into a position holding the micro-switch in an unactuated position.

30. The doll of claim 29, wherein the biasing member is a coil spring.

31. A toy configured to sense the presents of an object comprising:

a toy body;

an object-receiving opening;

a fixed structure mounted internal to the toy near the object-receiving opening, configured to support a micro-switch, and including a guide channel;

a floating pivot configured to pivot within and travel along the guide channel; and a movable structure including a contact arm and an actuator arm coupled with the fixed structure through the floating pivot, wherein the actuator arm is configured to actuate the micro-switch.

32. The toy of claim 31, wherein:

the contact arm includes a first portion and a second portion;

applying a force to the first portion of the contact arm spaced away from the floating pivot causes the movable structure to rotate, actuating the micro-switch; and applying a force to the second portion proximate the floating pivot causes the movable structure to translate linearly, actuating the micro-switch.

33. The toy of claim 32, further comprising a biasing member configured to bias the movable structure into a position holding the micro-switch in an unactuated position.

34. The toy of claim 33, wherein the biasing member is a coil spring.

* * * * *